US006071681A

United States Patent [19]

Morita et al.

[11] Patent Number: 6,071,681

[45] Date of Patent: Jun. 6, 2000

[54] METHOD FOR PRODUCING SILVER HALIDE PHOTOGRAPHIC LIGHT-SENSITIVE MATERIAL

[75] Inventors: Kiyokazu Morita; Hideki Hoshino; Shinichi Suzuki, all of Hino, Japan

[73] Assignee: Konica Corporation, Tokyo, Japan

[21] Appl. No.: 09/080,220

[22] Filed: May 18, 1998

[30] Foreign Application Priority Data

May 20, 1997 [JP] Japan ..... 9-129318

[51] Int. Cl.[7] ..... G03C 1/76; G03C 1/043; G03C 1/047; G03C 7/388; G03C 7/396

[52] U.S. Cl. ..... 430/531; 430/537; 430/539; 430/545; 430/628; 430/638; 430/639; 430/640; 430/935

[58] Field of Search ..... 430/215, 539, 430/638, 639, 640, 545, 537, 531, 628, 935

[56] References Cited

U.S. PATENT DOCUMENTS

| | | | |
|---|---|---|---|
| 3,063,838 | 11/1962 | Jenning et al. | 439/639 |
| 3,085,009 | 4/1963 | Chambers | 430/639 |
| 3,087,818 | 4/1963 | Chambers | 430/640 |
| 3,137,575 | 6/1964 | Chambers et al. | 430/639 |
| 3,272,631 | 9/1966 | Garrett et al. | 430/639 |
| 3,429,708 | 2/1969 | Klinger et al. | 430/639 |
| 4,193,801 | 3/1980 | Hopwood et al. | 430/510 |
| 4,444,926 | 4/1984 | Ogawa et al. | 430/640 |
| 5,019,494 | 5/1991 | Toya et al. | 430/639 |
| 5,075,209 | 12/1991 | Sasaki | 430/638 |
| 5,460,937 | 10/1995 | Blease et al. | 430/546 |

FOREIGN PATENT DOCUMENTS

| | | |
|---|---|---|
| 0 153 791 | 9/1985 | European Pat. Off. . |
| 0 653 670 A1 | 5/1995 | European Pat. Off. . |
| 0 752617A1 | 1/1997 | European Pat. Off. . |
| 98109112 | 8/1998 | European Pat. Off. . |

*Primary Examiner*—Richard L. Schilling
*Attorney, Agent, or Firm*—Finnegan, Henderson, Farabow, Garrett & Dunner, L.L.P.

[57] ABSTRACT

A method for producing a silver halide photographic light-sensitive material is disclosed, which comprises a support having thereon a silver halide emulsion layer and optionally another hydrophilic colloid layer. The method comprises the steps of (1) coating a coating solution of the silver halide emulsion layer or that of the hydrophilic colloid layer on the support, and (2) drying the coated layer, and the coating solution of the silver halide emulsion layer or that of the hydrophilic colloid layer comprises gelatin and a sugaralcohol.

3 Claims, No Drawings

METHOD FOR PRODUCING SILVER HALIDE PHOTOGRAPHIC LIGHT-SENSITIVE MATERIAL

FIELD OF THE INVENTION

This invention relates to a method for producing a silver halide photographic light-sensitive material, particularly relates to a production method by which the unevenness of the coating layer formed by coating at a high speed van be reduced.

BACKGROUND OF THE INVENTION

A silver halide photographic light-sensitive material, hereinafter simply referred to a light-sensitive material, is usually composed of a support and a hydrophilic binder, silver halide grains and various kinds of additive provided on the support. In the light-sensitive material, a plurality of layers are usually coated on the support. Consequently, the sum of the thickness of the layers comprised of the hydrophilic binder tends to increased when the layer constitution of the light-sensitive material is complicated. In such the case, degradation in the image sharpness, developing ability, desilverizing ability and physical properties of the light-sensitive material tends to be occurred. Such the tendency is considerably shown in a multi-layer color light-sensitive material which has many constituting layers. Accordingly, it is an important matter on the design of the color light-sensitive material to reduce the amount binder or gelatin in the layers.

However, the reduction of gelatin amount causes a problem relating to the viscosity and the setting temperature necessary to realize a stable coating of the coating liquid. For example, an evenness of the coated layer is formed at the time of coating the liquid since the viscosity of the coating solution is excessively lowered than the viscosity required for the stable coating, and that an unevenness of drying tends to be formed since the setting temperature is excessively lowered and setting ability of the coating liquid after coating and before drying the coated layer is degraded, by lowering the gelatin concentration when the amount of gelatin is reduced.

On the other hand, it is known as described in JP O.P.I. No. 95-148052 that the reduction of the binder raises a problem of sweating since the ratio of an oil-soluble component in the coated layer. The sweating is a phenomenon of forming oil droplets on the surface of the light-sensitive material when the light-sensitive material is stored under a high temperature and high humidity condition before or after processing. The oil droplet contains oil-soluble components of the light-sensitive material such as a high-boiling solvent, a coupler and a dye formed by the coupling reaction of a coupler with the oxidation product of a color developing agent. The oil-soluble components are oozed out on the surface of the light-sensitive material during the storage and gathered to form the droplets which are seen just like that the light-sensitive material sweats. The sweating causes considerable degradation of the surface glossiness, and the stability of color formation and formed dye of the light-sensitive material.

The sweating of the light-sensitive material after processing causes spreading of the dye formed in the light-sensitive material and degradation of the sharpness of image is resulted. JP O.P.I. No. 59-149347 describes a method for prevent the sweating phenomenon and the degradation of image sharpness caused by the spread of the dye by the use of a specific hardener. Such the hardener is hardly used in the industrial production process since the hardener vigorously reacts with gelatin of a coating solution in the period from the addition of the hardener into the coating solution to the coating of the solution, and an uniform coated layer cannot be formed. A method for similar purpose using an amidohydroquinone compound is described in JP O.P.I. Nos. 63-286848 and 63-287850. Such the substance is difficult to practically use since the compound gives many bad influence such as degradation in the photographic sensitivity, color forming efficiency and the fastness of the formed dye when an effective amount of the compound is added to the light-sensitive material together with the coupler. In the above-mentioned methods for preventing the sweating phenomenon, the spreading of the image is improved accompanied with the prevention of the sweating. However, the inventors have been found in some cases that the image sharpness is considerably lowered even when no sweating is occurred. It is understood that the sweating and the image spreading cannot be considered as the problem caused by the same reason.

Various countermeasures have been applied against such the problems. In concrete, a variety of thickener such as starch, dextran, dextran sulfate, carboxymethyl cellulose, cellulose sulfate, polyacrylamide, algic acid, sodium polyacrylate, polyvinylpyrrolidone, and a copolymer of styrene/maleic acid. Such the usual thickeners show some degree of effect to improve the unevenness of the coated layer by the viscosity increasing effect thereof. However, the thickeners cause a problem such that the physical properties of the layer after coating and drying is considerably degraded since the viscosity increasing effect of the thickener is reduced in the presence of a large amount of poly-valent metal ion or the addition of a large amount of the thickener is necessary to obtain a satisfactory viscosity increasing effect. The usually used thickeners have a little effect to raise the setting temperature of the liquid, and the setting temperature of the liquid is lowered by the addition of the thickener in some cases. Consequently, the thickener has little effect on the improvement of the drying unevenness of the layer, and raise a problem that the thickener results lowering in the final quality of the light-sensitive material. Furthermore, it has been found that addition of the thickener accelerates the sweating phenomenon on the light-sensitive material.

Japanese Patent Publication Open to Public Inspection (JP O.P.I.) No. 1-221736 discloses the use of glucose, maltose, sucrose, or a polysaccharide produced at out of the cell by a microbe fermentation of xylose together with a cation, and JP O.P.I. No. 6-67330 discloses the use of a natural high molecular polysaccharide derived from a red algac together with a cation. However, the polysaccharide have such drawbacks that the polysaccharide requires a high temperature to be dissolved, and causes degradation in the physical properties of the layer in water such as the easily formation of scratches in a wetted state and the degradation in the adhesiveness of the layer. The use of polysaccharide hardly inhibits the sweating of the light-sensitive material. The liquid in which the polysaccharide is used has a property that the viscosity and the setting temperature are affected by the presence of a usual cation such as $Li^+$, $Na^+$, $K^+$, or $Ca^{2+}$. Such the property of the polysacchride is undesirables since the viscosity and the setting temperature is largely influenced by an additive usually used at the preparation of the coating liquid such as an anionic surfactant and a water-soluble dye, since the property becomes a limitation on the design of the light-sensitive material.

SUMMARY OF THE INVENTION

The first object of the invention is to provide a method for producing a silver halide photographic light-sensitive material using a coating liquid having a high coating ability, in which the viscosity of the coating solution containing gelatin is raised without lowering in the setting temperature. The second object of the invention is to provide a silver halide photographic light-sensitive material having a good adhesiveness between different hydrophilic binder layers. The third object of the invention is to provide a silver halide photographic light-sensitive material in which the sharpness of image can be maintained even when the light-sensitive material stored under a high temperature and high humidity condition after processing.

The above-mentioned object of the invention is achieved by a method for producing a silver halide photographic light-sensitive material which comprises a support having thereon a silver halide emulsion layer and optionally another hydrophilic colloid layer, comprising the steps of (1) coating a coating solution of the silver halide emulsion layer or a coating solution of the hydrophilic colloid layer on the support and (2) drying the coated layer, and at least one of the coating solution of the silver halide emulsion layer and the coating solution of the hydrophilic colloid layer comprises gelatin and a sugaralcohol.

DETAILED DESCRIPTION OF THE INVENTION

The sugaralcohols usable in the invention are alcohols corresponding to ones in which an aldehyde group and a carboxyl group of the sugar is reduced to a primary alcohol group and secondary alcohol group, respectively, which include liner ones and cyclic ones. The sugaralcohol can be prepared by reducing a corresponding sugar by sodium amalgam, electric decomposition or a catalytic reduction under a high pressure. As the chain-structure sugaralcohol, for example, an erythritol such as D, L-erythritol, and meso-erythritol, a pentitol such as D, L-arabitol, adonitol, and xylitol, a hexytol such as D, L-sorbitol, D, L-mannitol, D, L-iditol, D, L-talitol, dulcitol and allitol, a heptitol, an octitol, a nonitol, a decitol, and a dodecitol are cited. As one having a cyclic structure, inositol, quercitol, quebrachitol, condulitol, vibrnitol, and mutilitol are cited. Both of one having a chain structure and one having a cyclic structure are preferably usable, and the chain structure sugaralcohols are particularly preferred.

As the sugaralcohol in the invention, a compound represented by the foregoing Formula 1 is preferred.

$$HOCH_2(CHOH)_nCH_2OH \qquad \text{Formula 1}$$

wherein n is an integer of from 2 to 6.

Among the compound represented by Formula 1, a compound having 6, n=4, or less carbon atoms is preferred. A compound having 4 or less carbon atoms is particularly preferably usable in the compound represented by Formula 1. The solubility of the sugaralcohol to be used in the invention is preferably not less than 5 g, particularly preferably not less than 20 g, in 100 ml of water at 20° C.

The sugaralcohol to be used in the invention is preferably one having a heat of dissolution in water of −20 cal/g, particularly not more than −30 cal/g is preferred. In the invention, the heat of dissolution, which is a kind of heat of mixing in general, is heat generated or adsorbed when a solid substance as a solute is mixed with water as a solvent. The heat of dissolution takes a positive value when heat is generated and takes a negative value when heat is adsorbed by dissolution. Many substances generate heat at the time of dissolution. It is found that the foregoing problems can be considerably improved by the addition of the sugaralcohol having a heat of dissolution of not more than −20 cal/g. When the sugaralcohol having a dissolution heat of nor more than −20 cal/g is added to the coating solution containing gelatin, the setting point of the coating solution is effectively raised. Consequently the coating solution can be uniformly coated even when the amount of gelatin is reduced. Moreover, the sweating of the light-sensitive material can be inhibited by the addition of such the sugaralcohol. Examples of such the sugaralcohol are as follows:

| | |
|---|---|
| HP-1 | Meso-erythritol |
| HP-2 | D-arabitol |
| HP-3 | Sorbitol |
| HP-4 | D-xylitol |
| HP-5 | Mannitol |
| HP-6 | D-inositol |
| HP-7 | myo-inositol |

In the invention, the sugaralcohol may be used singly or in combination of plural kinds thereof. The adding amount of the sugaralcohol is not more than 20% by weight, preferably not more than 10% by weight, particularly preferably not more than 7.5% by weight. In the invention, the sugaralcohol may be added to any emulsion layer and hydrophilic colloid layer of the light-sensitive material. The sugaralcohol is preferably added in an emulsion layer, particularly preferably in an emulsion layer and the layer adjacent to the emulsion layer.

The sugaralcohol relating to the invention can be added according to an usual method for adding a photographic additive, for example, the sugaralcohol may be added in the form of an aqueous solution or in the form of a powder. It is preferred to added the sugaralcohol after dissolved in water from the view point of easy handling. When the sugaralcohol is added in the form of solution, the solution may be added without any treatment or after addition of a preservative or antimold agent described in JP O.P.I. No. 3-157646.

Although the sugaralcohol relating to the invention may be added at any step between the producing process of the photographic emulsion, after production of the emulsion and just before the coating of the emulsion, the sugaralcohol is preferably added at a step between after the emulsion production process and just before the coating.

It is preferred that a water-soluble high molecular weight substance is added to the coating solution together with the sugaralcohol. The effect of the sugaralcohol is enhanced by adding a water-soluble high molecular compound to the coating solution containing the sugaralcohol. As the water-soluble high molecular compound, any of a synthesized high molecular compound and a natural high molecular compound are usable. The synthesized high molecular compound includes one having a nonionic group such as an ether group, an alkylene oxide group, a hydroxyl group, an amido group or an amino group, one having an anionic group such as a carboxylic group or its salt, a phosphoric group or its salt, or a sulfonic group or its sat, and one having a cationic group such as a quatenary ammonium group or a tertiary amino group in the molecule structure thereof. In both of the cases of synthesized and natural high molecular weight substance, a water-soluble high molecular weight substance having a nonionic group is preferred.

In the invention, the water-soluble high molecular weight substance having a solubility of not less than 0.05 g, particularly not less than 0.1 g, per 100 g of water at 20° C. is preferably used.

As the water-soluble high molecular compound, one having in the molecular thereof a repeating unit represented by the following Formula 2 or 3 in a ratio of 10 to 100 mole-% is preferable.

Formula 2

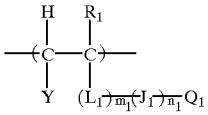

In the formula, $R_1$ is a hydrogen atom, an alkyl group having 1 to 20 carbon atoms, a halogen atom or a —$CH_2COOM$, $L_1$ is a di-valent linking group, $J_1$ is an alkylene group, an arylene group or an oxyalkylene group. $Q_1$ is —OM, —$NH_2$, —$SO_3M$, —$COR_2$, —COOM,

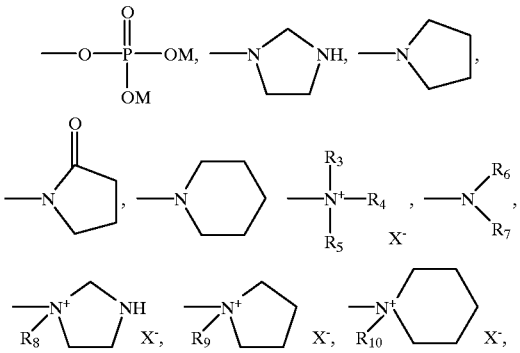

a hydrogen atom or $R_3$. $R_3$ through $R_{10}$ are each a an alkyl group having 1 to 20 carbon atoms, $X^-$ is an anion, $m_1$ and $n_1$ are each 0 or 1. Y is a hydrogen atom or $-(L_1)_{m_1}-(J_1)_{n_1}-Q_1$ Formula 3

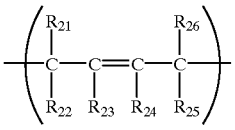

In the formula, $R_{21}$ through $R_{26}$ are each a hydrogen atom, an alkyl group having 1 to 8 carbon atoms, an aryl group having 6 to 20 carbon atoms or —$SO_3X$, X is a hydrogen atom, an alkali metal atom, an alkali-earth metal atom, an ammonium group or an amino group, and at least one of $R_{21}$ trough $R_{26}$ is —$SO_3X$.

In Formula 3, $R_1$ is a hydrogen atom, an alkyl group, a halogen atom or —$CH_2COOM$, preferably an alkyl group having 1 to 4 carbon atoms. The di-valent group represented by $L_1$ includes —CONH—, —NHCO—, —COO—, —COCO—, —CO— and —O—. $Q_1$ is preferably —COOM or —$SO_3M$, particularly —$SO_3M$. The cation represented by M is preferably an alkali metal ion and an ammonium ion.

The synthesized water-soluble polymer having the repeating unit represented by Formula 2 or 3 may be a homopolymer composed of such the repeating unit or a copolymer containing another component. As such the component, an acrylic acid ester, a methacrylic acid ester, a vinyl ester, an olefin, a styrene, a crotonic acid ester, itaconic acid di-ester, maleic acid di-ester, fumalic acid di-ester, an allyl compound, a vinyl ether, a vinyl ketone, a glysidyl ester and an unsaturated nitryl, and the acrylic acid ester, methacrylic acid ester and styrene are preferred.

Concrete examples of the water-soluble synthesized high molecular weight substance are shown below.

SP-1

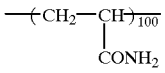

Mw = 20000

SP-2

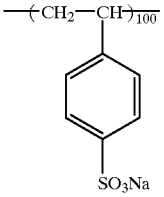

Mw = 10000

SP-3

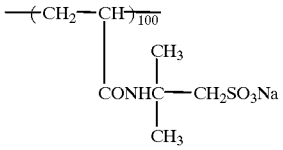

Mw = 20000

SP-4

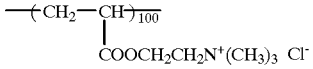

Mw = 10000

SP-5

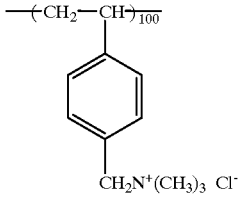

Mw = 150000

SP-6

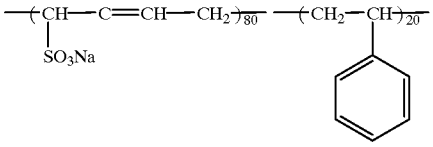

Mw = 40000

SP-7

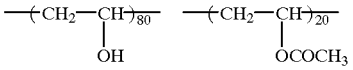

Mw = 40000

SP-8

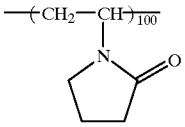

Mw = 9000

SP-9

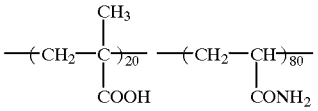

Mw = 40000

-continued

SP-10

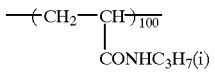

Mw = 40000

SP-11

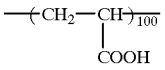

Mw = 40000

SP-12

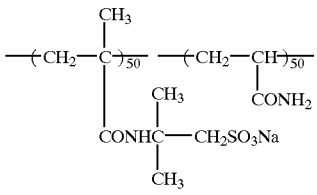

Mw = 40000

SP-13

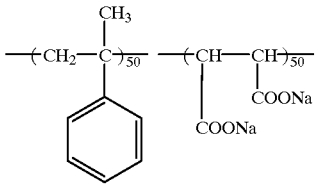

Mw = 5000

SP-14

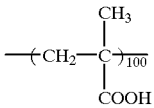

Mw = 20000

As the natural water-soluble high molecular weight substance, those described in "Comprehensive Technical Data of Water-soluble High Molecular Resin by Dispersion Method", edited by Keiei Kaihatsu Center, are cited, which include lignine, starch, pullulan, cellulose, dextran, dextrin, glycogen, algic acid, gelatin, collagen, gour gum, gum arabic, laminaran, lichenin, nigeran, and their derivatives. As the derivative, sulfonized, caroxylized, phosphazed, sulfoalkylized, acrboxyalkylized, and alkyl-phosphazed one, and their salts are preferred. Dextran, cellulose, pullulan, dextrin and their derivatives are preferable, and dextran and pullulan are particularly preferred. Dextran and pullulan to be used in the invention are each one kind of a polysaccharide and a polymer of D-glucose. For example, dextran and pullulan can be obtained by lowering the molecular weight of native dextran and native pullulan, respectively, by a partial decomposing polymerization method using an acid, alkali or enzyme. The native dextran and native pullulan are obtained by the action of a dextran forming bacterium such as Leuconostoc mesenteroides and a pullulan forming bacterium such as Aureobasidium pullurans on a solution of sucrose.

The weight average molecular weight of dextran or pullulan usable in the invention is from 1,000 to 2,000,000, preferably from 10,000 to 1,000,000, more preferably 20,000 to 500,000.

The water-soluble high molecular weight substance to be used in the invention may be used singly or in a combination of two or more kinds thereof. The use of two or more kinds of the water-soluble high molecular weight substance in combination is preferred. The using amount of the water-soluble high molecular weight substance is preferably from 5 to 50% by weight, particularly from 10 to 40% by weight, of the whole binder of the layer to which the water-soluble high molecular weight substance is added.

The water-soluble high molecular weight substance to be used in the invention may be added to any silver halide emulsion layer and a non-light-sensitive layer of the light-sensitive material. The water-soluble high molecular weight substance is preferably added to an emulsion layer and a layer adjacent to the emulsion layer.

The coating solution according to the invention containing the sugaralcohol contains gelatin. Gelatin is usually used in a concentration of from 2 to 10% by weight from the viewpoint of the viscosity and the setting ability of the solution. In the invention, a solution of lowered concentration of gelatin can be stably coated since the setting point of the solution is raised by the addition of the sugar alcohol. Although the upper limit of the gelatin concentration is not limited, it is usually not more than 10%, preferably not more than 7%.

As the foregoing gelatin, any kind of gelatin may be used as far as which is usually usable in a photographic light-sensitive material.

In the invention, gelatin or its derivative may be used. Lime-processed gelatin, acid processed gelatin such as one described in Bull. Soc, Sci. Phot. Japan, No. 16, p. 30, 1966, are usable and a hydrolysis product of gelatin and an enzyme decomposed product of gelatin are also usable. As the gelatin derivative, ones obtained by reacting various kinds of compound such as an acid halide, an acid anhydride, an isocyanate, bromoacetic acid, an alkanesultone, a vinylsulfonamide, a maleinimide, a polyalkylene oxide, or an epoxy compound, with gelatin are usable. Concrete examples of them are described in U.S. Pat. Nos. 2,614,928, 3,132,945, 3,186,846, and 3,312,553, British Patent Nos. 861,414, 1,033,189, and 1,005,784, Japanese Patent No. 42-26845.

A filler may be added to the coating solution according to the invention. As the filler, a polymer latex composed of polymer of various kinds of monomer described in U.S. Pat. Nos. 2,376,005, and 3,325,386, Japanese Patent Nos. 45-5331, and 46-22506, and JP O.P.I. No. 51-130217, and an inorganic particle such as colloidal silica described in Japanese Patent No. 47-50723 and JP O.P.I. No. 61-140939 are cited. The colloidal silica is particularly preferred. Furthermore, a preservant and an anti-mold agent described in JP O.P.I. No. 3-157646 are preferably added to a constituting layer of a silver halide photographic light-sensitive material to prevent breeding of a mold or bacterium which give a bad influence on the photographic properties and the storage ability of image.

A vinylsulfon type hardener or a chlorotriazine type hardener is preferably used as a hardener, which may be singly or in combination. Compounds described in JP O.P.I. Nos. 61-249054 and 61-245153 are preferably used. A lubricant and a matting agent described in JP O.P.I. Nos. 6-118543 and 2-73250 are preferably added to improve the physical properties of the surface of the color photographic light-sensitive material and those of the light-sensitive material after processing.

In the coating solution according to the invention, an optional silver halide usually used in a silver halide emulsion such as silver chloride, silver bromide, silver iodochloride, silver iodobromide, silver chlorobromide and silver chloroiodobromid may be used.

As the silver halide emulsion relating to the invention, a silver halide emulsion locally containing a high concentration of silver bromide. In such the case, the portion containing high concentration of silver bromide may be a portion epitaxially contacted to the silver halide grain, a portion in a form of core/shell emulsion, or a portion in a form of area having a different composition partially existed on the grain without formation of a complete layer. The composition may be differed continuously or discontinuously. It is particularly preferred that the portion containing high concentration of silver bromide is a portion at the corner of the crystal surface of the silver halide grain.

It is advantageous to contain a heavy metal ion in the silver halide emulsion relating to the invention. The heavy metal ion usable for such the purpose includes a metal of Groups VII through X of the period table such as ions of iron, iridium, platinum, palladium, nickel, rhodium, osmium, ruthenium and cobalt, and a transition metal of Group XII such as cadmium, zinc and mercury, and lead, rhenium, molybdenum, tungsten, gallium, and chromium. Among them, ions of iron, iridium, platinum, ruthenium, gallium and osmium are preferred. These metal ions can be added to the silver halide emulsion in a form of salt or complex salt.

When the foregoing heavy metal ion is in a form of complex, a cyanide ion, a thiocyanate ion, an isothiocyanate ion a cyanate ion, a chloride ion, a bromide ion, an iodide ion, a nitrate ion, a carbonyl ion and an ammonia ion are usable as a ligand of the complex. Among them, the cyanide ion, thiocyanate ion, isothiocyanate ion, chloride ion, and bromide ion are preferred.

The heavy metal compound may be added at an optional step of before the grain formation, during the grain formation, during the physical ripening after the formation of the grain of the emulsion. The heavy metal compound may be dissolved together with a halide salt and continuously added to during the all or a part of the grain formation process.

The heavy metal ion is added to the silver halide emulsion preferably in an amount of not lees than $1\times10^{-9}$ moles and not more than $1\times10^{-2}$ moles per mole of silver halide, and more preferably in an amount of not lees than $1\times10^{-8}$ moles and not more than $1\times10^{-5}$ moles per mole of silver halide.

A silver halide grain having any shape is optionally used in as the silver halide emulsion relating to the invention. A preferable example is a cubic grain having (100) face as the crystal surface thereof. Furthermore, a grain having a shape of octahedral, tetradecahedral or dodecahedral may be used which are form by the methods described in U.S. Pat. Nos. 4,183,756, and 4,225,666, JP O.P.I. No. 55-25689, Japanese Patent No. 55-42737 and J. Photogr. Sci. 21, p. 39, 1973. A grain having a twin face may also be used.

Silver halide grains having an uniform shape are preferably used as the silver halide grain relating to the invention. It is particularly preferred that two or more kinds of monodispersed emulsions are contained in the same layer.

Although there is no limitation on the grain size of the silver halide grain relating to the invention, the grain size is preferably from 0.1 to 1.2 $\mu$m, more preferably from 0.2 to 1.0 $\mu$m, from the viewpoint of a rapid processing ability and another photographic property such as the sensitivity.

The grain size can be measured by using the projection area or an approximate value of diameter. When the shape of the grains is substantially uniform, the distribution of the grain size can be expressed according to the diameter of the projection area with a high exactness.

The grain size distribution of the silver halide grains relating to the invention is preferably monodisperse having not more than 0.22, more preferably not more than 0.15, in the variation coefficient. It is particularly preferred that two or more kinds of monodisperse emulsions each having a variation coefficient of not more than 0.15 are contained in the same layer. The variation coefficient is a coefficient expressing the width of the grain size distribution, which is defined by the following equation.

$$\text{Variation coefficient}=S/R$$

in which S is a standard deviation of the grain size distribution, and R is an average diameter of grains.

When the grain has a spherical shape, the grain size is the diameter of the grain, and when the grain has a shape other than spherical or cubic, the diameter is a diameter of a disk image having the same area as the projection image of the grain.

Various kinds of apparatus and method for preparing silver halide emulsion known in the field of the art can be used to prepare the emulsion to be used in the light-sensitive material according to the invention.

The silver halide grain relating to the invention may be one prepared by any of an acidic method, a neutral method and an ammoniacal method. The grain may be one grown by one step or one grown after formation of a seed grain. The method for forming the seed grain and the method for growing the seed grain may be the same or different.

As the procedure for reacting a water-soluble silver salt and a water-soluble halide compound, any of an ordinary mixing method, a reverse mixing method, a double-jet mixing method and a combination thereof may be used, and the double-jet method is preferred. A pAg-controlled double-jet mixing method described in JP O.P.I. 54-48521 may be used as a form of the double-jet mixing method.

An apparatus described in JP O.P.I. Nos. 57-92523 and 57-92524 by which a solution of a water-soluble silver salt and a solution of a water-soluble halide compound are supplied through a adding device set up in a reaction mother liquid, an apparatus described in German Patent Publication for Public Offering No. 2,921,164 by which a solution of a water-soluble silver salt and a solution of a water-soluble halide compound are supplied while varying the concentration of the solutions, and an apparatus described in Japanese Patent No. 56-501776 by which grains are formed while maintaining the distance between each of the grains at a certain value by concentrating the reaction mother liquid by ultra-filtration at outside the reaction vessel.

A silver halide solvent such as a thioether may be used if it is necessary. Moreover, a compound having a mercapto group, a nitrogen-containing heterocyclic compound, or a compound such as a sensitizing dye may be added during or after the formation of the grain.

A sensitizing method using a gold compound, and that using a chalcogen sensitizer may be applied in combination to the silver halide emulsion relating to the invention.

A sulfur sensitizer, a selenium sensitizer, and a tellurium sensitizer may be used as the chalcogen sensitizer for the silver halide emulsion relating to the invention, and the sulfur sensitizer is preferred. The sulfur sensitizer includes a thiosulfate, allylthiocarbamidethiourea, allyisothiocyanate, cystine, p-toluenethiosulfonic acid, rhodanine and elemental sulfur.

The amount of the sulfur sensitizer is preferably changed according to the kind of silver halide emulsion and the expected effect of the sensitization, and the amount is within the range of from $5\times10^{-10}$ moles to $5\times10^{-5}$ moles, preferably from $5\times10^{-8}$ moles to $3\times10^{-5}$ moles, per mole of silver halide.

The gold sensitizer may be added in a form of chloroauric acid, and gold sulfide, and various kinds of gold complex. As the coordination compound of the gold complex, dimethylhydantoine, thiocyanic acid, mercaptotetrazole, and mercaptotriazole are cited. The using amount of the gold compound may be varied depending on the kind of the silver halide emulsion, the kind of the gold compound and the ripening condition, and preferably from $1\times10^{-4}$ moles to $1\times10^{-8}$ moles, more preferably from $1\times10^{-5}$ moles to $1\times10^{-8}$ moles, per mole of silver halide.

A reduction sensitizing method may be applied as the sensitizing method for the silver halide emulsion relating to the invention.

When a backing layer is provided on the light-sensitive material according to the invention, the backing layer may contain a matting agent. Although there is no limitation on the shape and size of the matting agent, it is desirable to use a spherical matting agent having an average size of from 10 $\mu$m to 50 $\mu$m.

The backing layer may contain a lubricant. As typical lubricants, a silicone-type lubricant described in U.S. Pat. No. 3,042,522, British Patent No. 955,061, U.S. Pat. Nos. 3,080,317, 4,004,927, 4,047,958, and 3,489,576, British Patent No. 1143118, and JP O.P.I. 60-140341, a higher fatty acid type, an alcohol type and an acid amide type lubricants described in U.S. Pat. Nos. 2,454,043, 2,732,305, 2,976,148, and 3,206,311, and German Patent Nos. 1,284,295, and 1,284,294, a metal soap described in U.S. Pat. No. 3,933,516, an ester type and an ether type lubricant described in U.S. Pat. Nos. 2,588,765, and 3121060, and British Patent No. 1,198,387, and a taurine type lubricant described in U.S. Pat. Nos. 2,502,437, and 3,042,222, are usable.

In the silver halide photographic light-sensitive material according to the invention, the photographic emulsion layer and another hydrophilic colloid layer can be coated on the support or on another coated layer by various coating methods. A dipping coating method, a roller coating method, a curtain coating method described in JP O.P.I. No. 4-212951 and an extrusion coating method may be applied for coating. The extrusion coater and the curtain coater by which two or more layers can be simultaneously coated are advantageously used. A thickner may be added to the coating solution of silver halide emulsion layer of another hydrophilic colloid layer for improving the coating suitability of the coating solution.

A support usually used in photographic light-sensitive material may be used as the support of the light-sensitive material according to the invention. In concrete, cellulose triacetate, polyethylene terephthalate, polyethylene naphthalte, syndiostatic polystyrene, paper and RC paper laminated with resin on both side of paper are usable as the support. The support may be subjected to coating of a subbing layer, a corona treatment or a flame treatment.

EXAMPLES

Example 1

Gelatin and the sugaralcohol according to the invention were mixed as shown in Table 1, and the viscosity and the setting point of the solution were measured according to PAGI method. Results of the measurement are shown in Table 1. The hardener was sodium salt of 2,4-dichloro-6-hydroxy-s-triazine. The dissolving heat of the sugaralcohols used in the Example were as follows.

| | |
|---|---|
| Meso-erythritol | −43 cal/g |
| Sorbitol | −25 cal/g |

TABLE 1

| Sample No. | Gelatin | Water-soluble high molecular weight substance | Sugar-alcohol | Water | Hardener 1% aqueous solution | Viscosity (cps) | Setting point |
|---|---|---|---|---|---|---|---|
| 101 Comp. | 10 g | | — | 190 g | H-1 10 ml | 22.5 | 24.6 |
| 102 Comp. | 7 g | | — | 193 g | H-1 7 ml | 18.7 | 17.0 |
| 103 Comp. | 7 g | SP-1 3 g | — | 190 g | H-1 7 ml | 40.5 | 16.5 |
| 104 Comp. | 7 g | SP-2 3 g | — | 190 g | H-1 7 ml | 40.5 | 17.3 |
| 105 Comp. | 7 g | SP-3 3 g | — | 190 g | H-1 7 ml | 46.3 | 13.1 |
| 106 Comp. | 7 g | SP-9 3 g | — | 190 g | H-1 7 ml | 40.3 | 14.2 |
| 107 Inv. | 10 g | | meso-erhthritol 1.0 g | 189 g | H-1 10 ml | 23.4 | 32.1 |
| 108 Inv. | 7 g | | meso-erythritol 1.0 g | 192 g | H-1 7 ml | 19.9 | 28.5 |
| 109 Inv. | 10 g | SP-3 3 g | meso-erythritol 1.0 g | 186 g | H-1 10 ml | 40.7 | 28.7 |
| 110 Inv. | 7 g | SP-3 3 g | meso-erythritol 1.0 g | 189 g | H-1 7 ml | 43.2 | 24.6 |

TABLE 1-continued

| Sample No. | Gelatin | Water-soluble high molecular weight substance | Sugar-alcohol | Water | Hardener 1% aqueous solution | Viscosity (cps) | Setting point |
|---|---|---|---|---|---|---|---|
| 111 Inv. | 7 g | SP-9 3 g | meso-erythritol 1.0 g | 189 g | H-1 7 ml | 40.3 | 22.8 |
| 112 Inv. | 10 g | | Sorbitol 0.5 g | 189 g | H-1 7 ml | 22.1 | 30.1 |
| 113 Inv. | 10 g | | Sorbitol 0.5 g | 189 g | H-1 7 ml | 21.2 | 29.1 |
| 114 Inv. | 10 g | | meso-erythritol 1.0 g | 189 g | H-1 7 ml | 20.5 | 30.3 |

As is shown in Table 1, the viscosity of gelatin solution is incresed a little and the setting point is considerably raised when the sugaralcohol is used according to the invention. When the water-soluble high molecular weight substance is added the setting point is lowered compared with the sample containing no such substance, but the setting point is raised and when the water-soluble polymer is used together with the sugaralcohol of the invention.

Example 2

A sample of silver halide color photographic paper, Sample 201, was prepared.

Both surfaces of paper having a weight of 180 g/m$^2$ were laminated with high density polyethylene to prepare an paper support. The surface on which a emulsion to be coated was laminated with molten polyethylene in which 15% by weight of surface treated anatase type titanium oxide was dispersed. Thus a reflective support was prepared. The reflective support was subjected to a corona discharge treatment, and coated with a gelatin subbing layer. Then the following layers were coated on the subbing layer to prepare Sample 201 of silver halide color photographic light-sensitive material. Compounds H-1 and H-2 were added as hardeners.

| | Amount in g/m$^2$ |
|---|---|
| 7th Layer (Protective layer) | |
| Gelatin | 1.00 |
| DIDP/DBP | 0.002/0.003 |
| Silicon dioxide | 0.003 |
| 6th Layer (UV absorbing layer) | |
| Gelatin | 0.40 |
| AI-1 | 0.01 |
| UV absorbent UV-1 | 0.12 |
| UV absorbent UV-2 | 0.04 |
| UV absorbent UV-3 | 0.16 |
| Stain preventing agent HQ-5 | 0.04 |
| PVP | 0.03 |
| 5th Layer (Red-sensitive layer) | |
| Gelatin | 1.30 |
| Red-sensitive silver chlorobromide emulsion Em-R | 0.21 |
| Cyan coupler C-1 | 0.25 |
| Cyan coupler C-2 | 0.08 |
| Dye image stabilizing agent ST-1 | 0.10 |

-continued

| | Amount in g/m$^2$ |
|---|---|
| Stain preventing agent HQ-4 | 0.004 |
| DBP/DOP | 0.10/0.20 |
| 4th Layer (UV absorbing layer) | |
| Gelatin | 0.94 |
| UV absorbent UV-1 | 0.28 |
| UV absorbent UV-2 | 0.09 |
| UV absorbent UV-3 | 0.38 |
| AI-1 | 0.02 |
| Stain preventlng agent HQ-5 | 0.10 |
| 3rd Layer (Green-sensitive layer) | |
| Gelatin | 1.30 |
| AI-2 | 0.01 |
| Green-sensitive silver chlorobromide emulsion Em-G | 0.14 |
| Magenta coupler M-1 | 0.20 |
| Dye image stabilizing agent ST-3 | 0.20 |
| Dye image stabilizing agent ST-4 | 0.20 |
| DIDF/DBP | 0.13/0.13 |
| 2nd Layer (Interlayer) | |
| Gelatin | 1.20 |
| AI-3 | 0.01 |
| Stain preventing agent HQ-2 | 0.03 |
| Stain preventing agent HQ-3 | 0.03 |
| Stain preventing agent HQ-4 | 0.05 |
| Stain preventing agent HQ-5 | 0.23 |
| DIDP/DBP | 0.06/0.02 |
| Fluorescent whitening agent W-1 | 0.10 |
| 1st Layer (Blue-sensitive layer) | |
| Gelatin | 1.20 |
| Blue-sensitive silver chlorobromide emulsion Em-B | 0.26 |
| Yellow coupler Y-1 | 0.70 |
| Dye image stabilizing agent ST-1 | 0.10 |
| Dye image stabilizing agent ST-2 | 0.10 |
| Dye image stabilizing agent ST-5 | 0.01 |
| Stain preventing agent HQ-1 | 0.01 |
| Image stabilizing agent A | 0.15 |
| DBP/DNP | 0.15/0.10 |

Support

Polyethylene laminated paper containing a small amount of colorant

Image stabilizing agent A: P-t-octylphenol

DBP: Dibutyl phthalate

DNP: Dinonyl phthalate

DON: Dioctyl phthalate

DIDP: Di-i-decyl phthalate

PVP: Polyvinylpyrrolidone

HQ-1: 2,5-di-t-octylhydroquinone
HQ-2: 2,5-di-sec-dodecylhydroquinone
HQ-3: 2,5-di-sec-tetradecylhydroquinone
HQ-4: 2-sec-dodecyl-5-sec-tetradecylhydroquinone
HQ-5: 2,5-di(1,1-dimethyl-4-hexyloxycarbonyl) butylhydroquinone
M-1
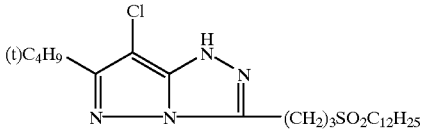
C-1
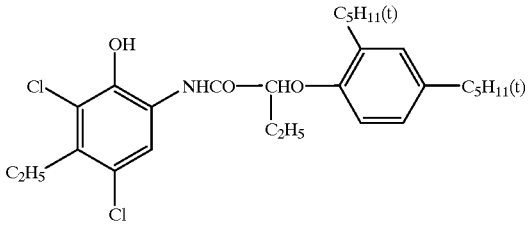
C-2
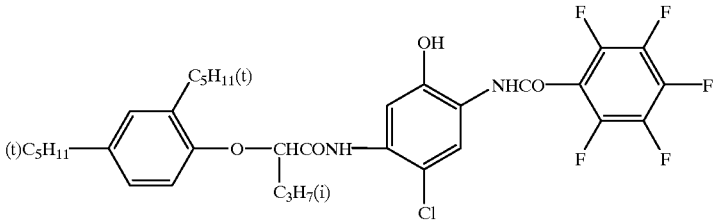
ST-3
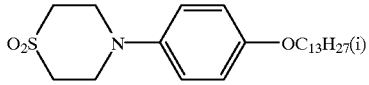
ST-4
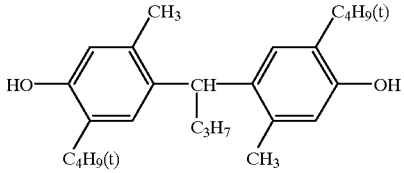
Y-1
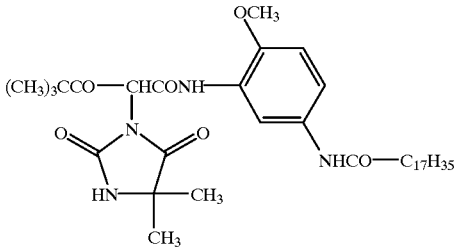
ST-1
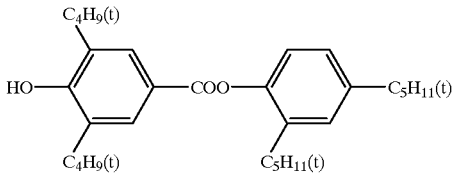

-continued
ST-2
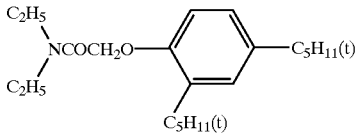
ST-5
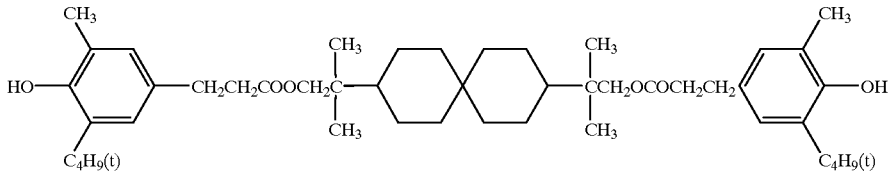
UV-1
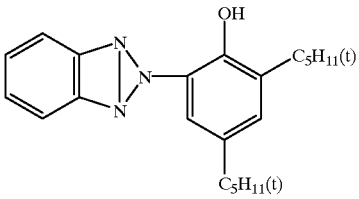
UV-2
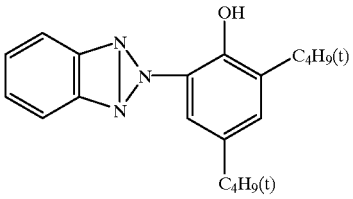
UV-3
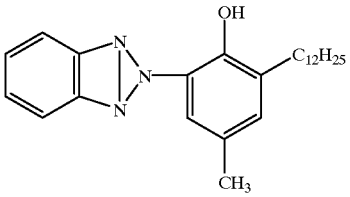
H-2
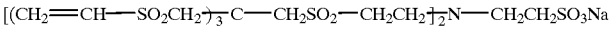
AI-1
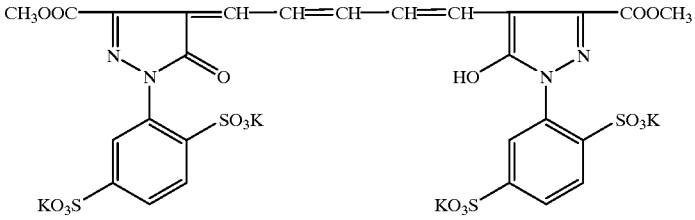
AI-2
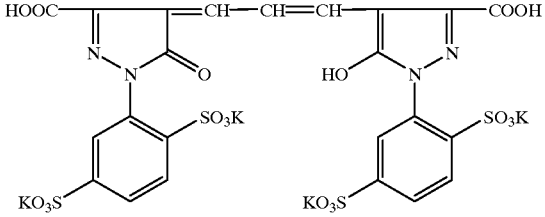

-continued

AI-3

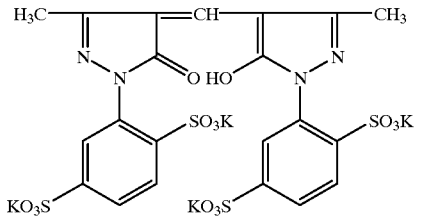

W-1

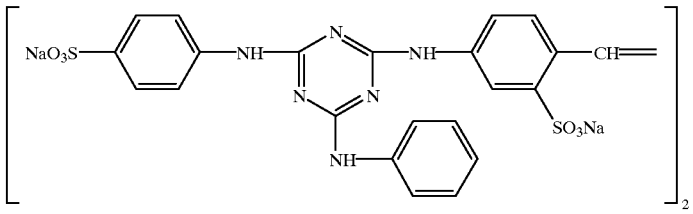

Preparation of Blue-sensitive Silver Halide Emulsion

The following Solution A and Solution B were added spending 30 minutes to 1 liter of 2% gelatin solution kept at 40° C., while controlling the pAg and pH at 7.3 and 3.0, respectively. Further the following Solution C and Solution D were added spending 180 minutes while controlling the pAg and pH at 8.0 and 5.5, respectively. The control of the pAg was performed by the method described in JP O.P.I. No. 59-45437, and the control of pH was performed by the use of a solution of sulfuric acid or sodium hydroxide.

| | |
|---|---|
| Solution A | |
| Sodium chloride | 3.42 g |
| Potassium bromide | 0.03 g |
| Water tomake | 200 ml |
| Solution B | |
| Silver nitrate | 10 g |
| Water to make | 200 ml |
| Solution C | |
| Sodium chloride | 102.7 g |
| $K_2IrCl_6$ | $4 \times 10^{-8}$ moles/mole of Ag |
| $K_4Fe(CN)_6$ | $2 \times 10^{-5}$ moles/mole of Ag |
| Potassium bromide | 1.0 g |
| Water to make | 600 ml |
| Solution D | |
| Silver nitrate | 300 g |
| Water to make | 600 ml |

After the addition, the emulsion was desalted by using a 5% solution of Demol N, manufactured by Kao-Atlas Co., Ltd., and a 20% solution of magnesium sulfate, and mixed with an aqueous gelatin solution. Thus monodisperse cubic grain emulsion EMP-1 was obtained, which had an average size of 0.71 μm, a variation coefficient of size distribution of 0.07 and a silver chloride content of 99.5 mole-%. Monodisperse cubic grain emulsion EMP-1B was prepared in the same manner as in EMP-1 except that the adding time of Solution A and Solution B, and that of Solution C and Solution D were changed. Emulsion EMP-1B had an average size of 0.64 μm, a variation coefficient of size distribution of 0.07 and a silver chloride content of 99.5 mole-%.

Emulsion EMP-1 was subjected to an optimal chemical sensitization at 60° C. using the following compounds. Besides, Emulsion EMP-1B was also subjected to an optimal chemical sensitization using the same compounds. Then Emulsions EMP-1 and EMP-1B were mixed in a ratio of 1:1 in terms of silver to prepare a blue sensitive silver halide emulsion Em-B.

| | |
|---|---|
| Sodium thiosuifate | 0.8 mg/mole of AgX |
| Chloroauric acid | 0.5 mg/mole of AgX |
| Stabilizing agent STAB-1 | $3 \times 10^{-4}$ moles/mole of AgX |
| Stabilizing agent STAB-2 | $3 \times 10^{-4}$ moles/mole of AgX |
| Stabilizing agent STAB-3 | $3 \times 10^{-4}$ moles/mole of AgX |
| Sensitizing dye BS-1 | $4 \times 10^{-4}$ moles/mole of AgX |
| Sensitizing dye BS-i | $1 \times 10^{-4}$ moles/mole of AgX |

Preparation of Green-sensitive Silver Halide Emulsion

Monodisperse cubic grain emulsion EMP-2 was prepared in the same manner as in EMP-1 except that the adding time of Solution A and Solution B, and that of Solution C and Solution D were changed. Emulsion EMP-2 had an average size of 0.40 μm, a variation coefficient of size distribution of 0.08 and a silver chloride content of 99.5 mole-%. Further. monodisperse cubic grain emulsion EMP-2B was prepared, which had an average size of 0.50 μm, a variation coefficient of size distribution of 0.08 and a silver chloride content of 99.5 mole-%.

Emulsion EMP-2 was subjected to an optimal chemical sensitization at 55° C. using the following compound. Besides, Emulsion EMP-2B was also subjected to an optimal chemical sensitization using the same compounds. Then Emulsions EMP-2 and EMP-2B were mixed in a ratio of 1:1 in terms of silver to prepare a green sensitive silver halide emulsion Em-G.

| | |
|---|---|
| Sodium thiosulfate | 1.5 mg/mole of AgX |
| Chloroauric acid | 1.0 mg/mole of AgX |
| Stabilizing agent STAB-1 | $3 \times 10^{-4}$ moles/mole of AgX |
| Stabilizing agent STAB-2 | $3 \times 10^{-4}$ moles/mole of AgX |
| Stabilizing agent STAB-3 | $3 \times 10^{-4}$ moles/mole of AgX |
| Sensitizing dye GS-1 | $4 \times 10^{-4}$ moles/mole of AgX |

Preparation of Red-sensitive Silver Halide Emulsion

Monodisperse cubic grain emulsion EMP-3 was prepared in the same manner as in EMP-1 except that the adding time of Solution A and Solution B, and that of Solution C and Solution D were changed. Emulsion EMP-3 had an average size of 0.40 μm, a variation coefficient of size distribution of 0.08 and a silver chloride content of 99.5 mole-%. Further. monodisperse cubic grain emulsion EMP-3B was prepared, which had an average size of 0.38 μm, a variation coefficient of size distribution of 0.08 and a silver chloride content of 99.5 mole-%.

Emulsion EMP-3 was subjected to an optimal chemical sensitization at 60° C. using the following compound. Besides, Emulsion EMP-2B was also subjected to an optimal chemical sensitization using the same compounds. Then Emulsions EMP-3 and EMP-3B were mixed in a ratio of 1:1 in terms of silver to prepare a red sensitive silver halide emulsion Em-R.

| | |
|---|---|
| Sodium thiosulfate | 1.8 mg/mole of AgX |
| Chloroauric acid | 2.0 mg/mole of AgX |
| Stabilizing agent STAB-1 | $3 \times 10^{-4}$ moles/mole of AgX |
| Stabilizing agent STAB-2 | $3 \times 10^{-4}$ moles/mole of AgX |
| Stabilizing agent STAB-3 | $3 \times 10^{-4}$ moles/mole of AgX |
| Sensitizing dye RS-1 | $1 \times 10^{-4}$ moles/mole of AgX |
| Sensitizing dye RS-2 | $1 \times 10^{-4}$ moles/mole of AgX |

In the red-sensitive emulsion, $2\times10^{-3}$ moles per mole of silver halide of SS-1 was added.

STAB-1: 1-(3-acetoamidophenyl)-5-mercaptotetrazole

STAB-2: 1-phenyl-5-mercaptotetrazole

STAB-3: 1-(4-ethoxyphenyl)-5-mercaptotetrazole

BS-1

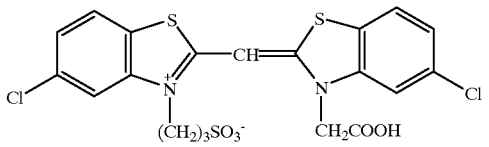

BS-2

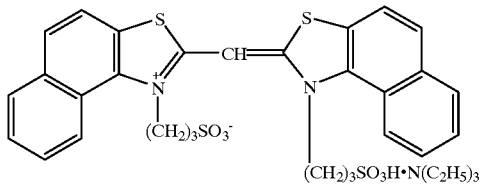

GS-1

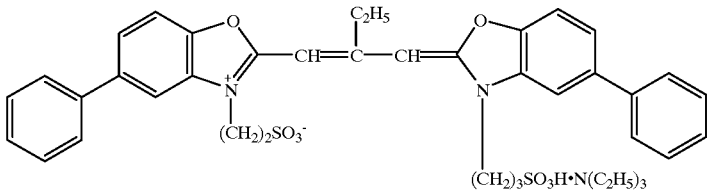

RS-1

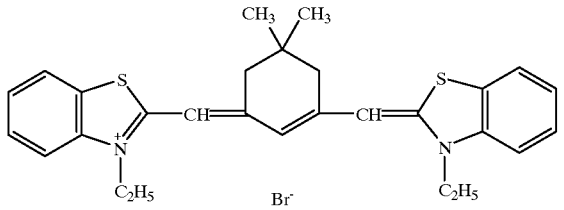

RS-2

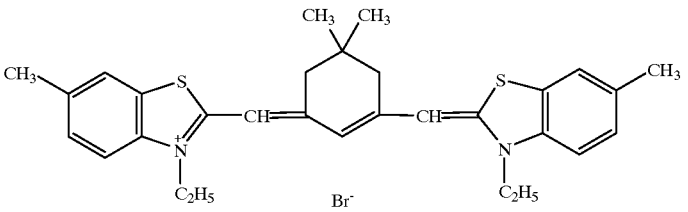

-continued

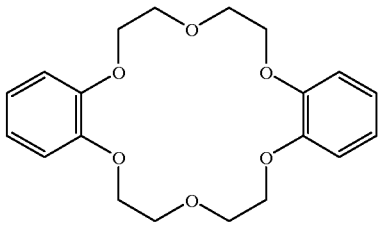

Sensitizing dyes RS-1 and RS-2 are each added to the emulsion in a form of dispersion prepared by the method described in JP O.P.I. No. 6-308656 in which the dye is contained in a form of solid fine particles.

Samples 202 through 206 were prepared in the same manner as in Sample 101 except that the sugaralcohol according to the invention was added as shown in Table 2. Sample 107 was prepared in the same manner as in Sample 101 except that the amount of gelatin was reduced so that the gelatin content was become to 70% of that in Sample 201. Samples 208 to 212 were prepared in the same manner as in Sample 207 except that the sugaralcohol according to the invention was added in each of the sample, the amount of the sugaralcohol is shown with respect to the amount of gelatin.

Thus obtained samples were conditioned at 25° C. and 55% RH, exposed to light in an ordinary manner, and subjected to the processing. The resistivity to scratch of each of the processed sample was measured. The situation of the coated layer and the adhesiveness of the coated layer to the support were evaluated according to the following norms. Results are shown in Table 3.

<Evaluation of Situation of Coated Layer>

The situation of coated layer was visually evaluated as follows:

A: Degree of the uneveness is smal and and no problem was founf from the viewpoint of practical use.

B: Unevenness of coated layer caused by insufficient setting is formed at a part of the sample.

C: Unevenness of coated layer caused by insufficient setting is formed at all area of the sample.

<Adhesiveness of Coated Layer to the Support>

The samples were each stood for 7 days and immersed in the following developing solution for 5 minutes at 38° C. Then that samples were scratched in a lattice shape and rubbed by a sponge for ten times. The situation of peeled layer was visually observed and classified to the following ranks.

A: No peel was observed.

B: 10% of the layer was peeled.

C: 50% of the layer was peeled.

D: 80% of the layer was peeled.

E: All the layer was peeled.

<Processing procedure>

| Processing Step | Processing Temperature | Processing time |
|---|---|---|
| Color development | 38.0° C. | 45 seconds |
| Bleach-fixing | 35.0° C. | 45 seconds |

SS-1

-continued

| Processing Step | Processing Temperature | Processing time |
|---|---|---|
| Stabilizing | 35.0° C. | 90 seconds |
| Drying | 60° C | 30 seconds |
| | | Total 210 seconds |

The compositions of the processing solutions were as follows.

Color Developer Tank Solution and Replenisher

| | Tank solution | Replenisher |
|---|---|---|
| Pure water | 800 ml | 800 ml |
| Triethylenediamine | 2 g | 3 g |
| Ethylene glycol | 10 g | 10 g |
| Potassium bromide | 0.01 g | — |
| Sodium chloride | 3.5 g | — |
| Potassium sulfite | 0.25 g | 0.5 g |
| N-ethyl-N-(β-sulfonamido)-3-methyl-4-aminoaniline sulfate | 6.0 g | 10.0 g |
| N,N-diethylhydroxylamine | 6.8 g | 6.0 g |
| Triethanolamine | 10.0 g | 10.0 g |
| Sodium diethylenetriaminepentaacetate | 2.0 g | 2.0 g |
| Fluorescent whitening agent (4,4'diaminostyrbene-disulfonic acid derivative) | 2.0 g | 2.5 g |
| Potassium carbonate | 30 g | 30 g |

Each solution was made up to 1 liter by water, and pH value of the tank solution and the replenisher were adjusted to 10.10 and 10.60, respectively.

<Bleach-fixer Tank Solution and Replenisher>

| | |
|---|---|
| Ferric ainmonium diethylenetriamine-pentaacetate dihydrate | 65 g |
| Diethylenetriaminepentaacetic acid | 3 g |
| Ammonium thiosulfate (70% aqueous solution) | 100 ml |
| 2-amino-5-mercapto-1,3,4-thiadiazole | 2.0 g |
| Ammonium sulfite (40% aqueous solution) | 27.5 ml |

The solution was made up to 1 liter by water and the pH was adjusted to 5.0 by potassium carbonate or glacial acetic acid.

<Stabilizer Tank Solution and Replenisher>

<Stabilizer Tank Solution and Replenisher>

| | |
|---|---|
| o-phenylphenol | 1.0 g |
| 5-chloro-2-methyl-4-isothiazoline-3-one | 0.02 g |
| 2-methyl-4-isothiazoline-3-one | 0.02 g |
| Diethylene glycol | 1.0 g |
| Fluorescent whitening agent (Cipanol SFP) | 2.0 g |
| 1-hydroxyethylidene-1,1-diphosphonic acid | 1.8 g |
| Bismuth chloride (45% aqueous solution) | 0.65 g |
| Magnesium sulfate heptahydrate | 0.2 g |
| PVP | 1.0 g |
| Ammonia water (25% aqeous solution of ammonium hydroxide) | 2.5 g |
| Trisodium nitrylotriacetic acid | 1.5 g |

The solution was made up to 1 liter by water and the pH was adjusted to 7.5 by sulfuric acid or ammonia water.

<Resistivity to Scratch>

The processed sample was twice immersed in the developer for 45 seconds at the developing temperature and scratched by a sapphire stylus having a radium of 0.3 mm and moving parallel with the sample surface, while continuously increasing the load applying to the stylus of from 0 to 200 g. The minimum load weigh necessary to form a scratch on the layer surface of the sample was measured. Results are shown in Table 2.

TABLE 2

| Sample No. | Water-soluble high molecular weight substance | Sugar alcohol | Status of coated layer | Resistivity to scratch (g) | Adhesiveness |
|---|---|---|---|---|---|
| 201 Comp. | — | — | B | 70.5 | B |
| 202 Comp. | SP-1 1–7 layer 10 wt % | — | C | 65.5 | C |
| 203 Comp. | SP-3 1–7 layer 30 wt % | — | C | 34.5 | C |
| 204 Inv. | — | meso-erythritol 1–7 layer 10 wt % | A | 112.5 | A |
| 205 Inv. | — | meso-erythritol 1–7 layer 5 wt % | A | 98.6 | A |
| 206 Inv. | SP-3 1–7 layer 30 wt % | meso-erythritol 1–7 layer 10 wt % | A | 93.2 | A |
| 207 Comp. | — | — | C | 52.3 | B |
| 208 Comp. | SP-1 1–7 layer 10 wt % | — | C | 50.3 | C |
| 209 Inv. | — | meso-erythritol 1–7 layer 10 wt % | A | 95.3 | A |
| 210 Inv. | SP-1 1–7 layer 10 wt % | meso-erythritol 1–7 layer 5 wt % | A | 97.2 | A |
| 211 Inv. | — | D-sorbitol 1–7 layer 10 wt % | A | 84.5 | A |
| 212 Inv. | — | D-sorbitol 1–7 layer 10 wt % | A | 75.3 | A |

As is understood from Table 3, the samples according to the invention have no problem in the situation of coated layer, resistivity to scratch and layer adhesiveness to support.

Example 3

Samples 302 through 314 were prepared in the same manner as in Sample 201 except that the hydroxyl group-containing compound according to the invention and the water-soluble polymer were added. The amount of the sugaralcohol is shown with respect to the amount of gelatin. The sharpness of the image and the sweating and the adhesion of the samples were evaluated by the following method. Results of the evaluation are shown in Table 3. In Table 3, Comparative compound-1 is glucose and Comparative compound-2 is glycerol. The dissolving heat of the comparative compounds were as follows.

| | |
|---|---|
| Glucose | −14 cal/g |
| Glycerol | 15 cal/g |

<Sharpness of Image>

The samples were stood for 24 hours at a temperature of 40° C. and a relative humidity of 60% for satisfactorily hardening of the layera of the sample. The samples were each exposed to green light and red light through a pattern for measuring MTF. The exposed samples were processed by the foregoing processing and stood for 7 days under the following conditions. After standing, the MTF of the samples were measured at 3 lines/mm by the method described in Mees, "The Theory of the Photographic Process, 3rd ed." Macmilan.

Condition 1: 25° C., 60% RH, 7 days

Condition 2: 80° C., 60% RH, 7 days

<Sweating>

The samples were stood fro 24 hours at a temperature of 40° C. and a relative humidity of 60% to satisfactorily stabilize the hardening of the layer. The samples were processed according to the foregoing processing procedure and stood under the foregoing Condition 2, and sweating of the samples were visually observed.

A: Sweating is hardly observed.

B: Sweating is slightly observed but acceptable for practical use

C: Sweating is considerably formed so as to degrade the image quality.

<Adhesion Between Surfaces of Light-sensitive Materials>

The samples were stood for 2 days at a temperature of 25° C. and a relative humidity of 80%, and piled so that the emulsion surface of the sample was contacted to the emulsion surface of the same kind of sample. A weight of 1 kg was put on the pile of the samples and stood for 1 week. Then the samples was separated and the situation of the sample surface was visually evaluated.

A: Adhesion was hardly observed.

B: A part of the sample was adhered but acceptable for practical use

C: Whole surface of the sample was adhered.

TABLE 3

| Sample No. | Adding amount of compound of the invention (wt %) | Adding amount Water-soluble high molecular weight substance (wt %) | MTF Condition 1 | MTF Condition 2 | Sweating | Adhesion |
|---|---|---|---|---|---|---|
| 201 Comp. | — | — | 0.70 | 0.60 | B | C |
| 302 | Comparative | — | 0.71 | 0.59 | B | C |

TABLE 3-continued

| Sample No. | Adding amount of compound of the invention (wt %) | Adding amount Water-soluble high molecular weight substance (wt %) | MTF Condition 1 | MTF Condition 2 | Sweating | Adhesion |
|---|---|---|---|---|---|---|
| Comp. 303 | compound-1 10 wt % Comparative compound-2 10 wt % | — | 0.72 | 0.56 | C | C |
| Comp. 304 | Erythritol 10 wt % | — | 0.73 | 0.71 | A | A |
| Inv. 305 | Sorbitol 10 wt % | — | 0.71 | 0.66 | A | B |
| Inv. 306 | Erythritol 5 wt % | — | 0.72 | 0.70 | A | B |
| Inv. 307 | — | Dextran 30 wt % | 0.70 | 0.61 | B | C |
| Comp. 308 | Comparative compound-1 10 wt % | Dextran 30 wt % | 0.70 | 0.61 | B | C |
| Comp. 309 | Comparative compound-1 10 wt % | SP-1 30 wt % | 0.71 | 0.62 | B | C |
| Comp. 310 | Erythritol 10 wt % | Dextran 30 wt % | 0.73 | 0.72 | A | A |
| Inv. 311 | Erythritol 10 wt % | SP-1 20 wt % | 0.72 | 0.70 | A | B |
| Inv. 312 | Erythritol 5 wt-% | SP-1 20 wt % | 0.72 | 0.70 | A | B |
| Inv. 313 | Sorbitol 10 wt % | SP-1 30 wt % | 0.70 | 0.68 | B | B |
| Inv. 314 | Sorbitol 5 wt % | SP-9 20 wt % | 0.69 | 0.67 | B | B |
| Inv. | | | | | | |

As is understood from Table 3, the spreading of the image, and the sweating are inhibited in the samples according to the invention.

What is claimed is:

1. A method for producing a silver halide color photographic light-sensitive material which comprises a support having thereon a silver halide emulsion layer and optionally another hydrophilic colloid layer, said method comprising:

applying a coating solution of the silver halide emulsion layer, which contains an oil droplet containing a color-forming coupler, and a coating solution of the hydrophilic colloid layer to the support to form a coated layer; and drying the coated layer, wherein at least one of the coating solution of the silver halide emulsion layer and the coating solution of the hydrophilic colloid layer comprises:

(a) a gelatin;

(b) a sugar alcohol that has a dissolution heat of not more than −30 cal/g and is represented by Formula 1, $$HOCH_2(CHOH)_nCH_2OH \quad (1)$$

where n is an integer of from 2 to 6; and (c) a water-soluble high molecular weight substance, wherein said water-soluble high molecular weight substance is dextran.

2. The method of claim 1, wherein the coating solution contains gelatin in an amount of 10% by weight.

3. The method of claim 1, wherein the sugaralcohol is erythritol.

* * * * *